US008834222B2

(12) United States Patent
Ewing

(10) Patent No.: US 8,834,222 B2
(45) Date of Patent: Sep. 16, 2014

(54) FLOTATION DEVICE WITH WATERPROOF SPEAKERS AND POCKET

(76) Inventor: Taylor Walker Ewing, Virginia Beach, VA (US)

( * ) Notice: Subject to any disclaimer, the term of this patent is extended or adjusted under 35 U.S.C. 154(b) by 340 days.

(21) Appl. No.: 13/339,399

(22) Filed: Dec. 29, 2011

(65) Prior Publication Data

US 2012/0171912 A1 Jul. 5, 2012

Related U.S. Application Data

(60) Provisional application No. 61/427,877, filed on Dec. 29, 2010.

(51) Int. Cl.
*B63C 9/08* (2006.01)

(52) U.S. Cl.
USPC ..... 441/106

(58) Field of Classification Search
CPC ..... B63C 9/08; B63C 9/11; B63C 9/125; B63C 9/13; B63C 9/135; B63C 9/15; B63C 9/18; B63C 9/21
USPC ..... 441/80, 88, 102, 106, 123, 125, 129, 441/136
See application file for complete search history.

(56) References Cited

U.S. PATENT DOCUMENTS

| | | | | |
|---|---|---|---|---|
| 4,322,585 | A | 3/1982 | Liautaud | |
| 4,539,700 | A * | 9/1985 | Sato | 381/333 |
| 4,744,398 | A | 5/1988 | Clark | |
| 4,876,724 | A | 10/1989 | Suzuki | |
| 6,439,941 | B2 * | 8/2002 | McClure et al. | 441/89 |
| 7,006,651 | B2 * | 2/2006 | Ueki | 381/396 |
| 7,023,338 | B1 * | 4/2006 | Foth | 340/539.13 |
| 7,035,422 | B1 * | 4/2006 | Wiener | 381/388 |
| 2006/0182297 | A1 | 8/2006 | Cyr et al. | |
| 2009/0311928 | A1 * | 12/2009 | McClintock et al. | 441/89 |
| 2011/0075874 | A1 * | 3/2011 | Richards | 381/334 |

OTHER PUBLICATIONS

Fallon, Sean; MP3 Jacket With Shoulder Speakers: May Double as a Life Preserver; Gizmodo.com; Jan. 11, 2008; http://gizmodo.com/344016/mp3-jacket-with-shoulder-speakers-may-double-as-a-life-preserver.

* cited by examiner

*Primary Examiner* — Daniel V Venne
(74) *Attorney, Agent, or Firm* — Brian L. Michaelis; Joseph M. Walker; Seyfarth Shaw LLP

(57) ABSTRACT

A flotation device including hardwired waterproof speakers and one or more waterproof pockets is disclosed herein. The flotation device may be a vest including one or more internal foam pads that provide flotation. The waterproof speakers may be integrated into the shoulders of the vest, for example, in the shoulders on the front or back of the vest. The speakers may be wired internally through the vest to the waterproof pocket, in which an amplifier and/or a handheld media device may be stored.

15 Claims, 5 Drawing Sheets

FLOTATION DEVICE WITH WATERPROOF SPEAKERS AND POCKET

CROSS REFERENCES TO RELATED APPLICATIONS

This application claims the benefit of U.S. Provisional Patent Application Ser. No. 61/427,877, filed on Dec. 29, 2010, the contents of which are incorporated herein by reference in their entirety.

FIELD

The present disclosure relates to audio and communications systems. More specifically, the present disclosure relates to wearable garments with integral audio and communications systems.

BACKGROUND

In today's technological world, there are multiple handheld digital audio players, communication devices, media players, and computing devices, such as MP3 players, smartphones, mobile phones, and PDAs (personal digital assistants), that are widely used. These handheld devices are typically used to play and/or display media, such as audio, video, and images.

In general, when using a handheld device, such as an MP3 player, a user connects wired headphones or earbuds to the handheld device, and the headphones or earbuds are placed in or over the user's ears. The audio sound is then transferred through the headphones or earbuds to the user's ears. However, most of these headphones or earbuds interfere with or block ambient or outside noise from being heard by the user.

When participating in action sports, the wiring connecting the headphones or earbuds to the handheld device may also interfere with the user's range of motion, comfort, and may present unwanted issues. For example, the headphones may be pushed in the user's ears when the user falls, the wires may become tangled, caught on or in surrounding objects, obstruct the user's visibility, limit the user's ability to turn his/her head in different directions, or otherwise interfere with the user. Further, most of the handheld devices are not waterproof and cannot be used in situations where the handheld devices may come into contact with or be submerged in water.

SUMMARY

In an illustrative embodiment, a personal flotation device, such as a vest, is disclosed herein that generally does not suffer from many of the above-described drawbacks of headphones, earbuds, and wires by placing speakers on the shoulders of the vest. In an illustrative embodiment, the vest disclosed herein provides the user the ability to listen to audio transmissions, for example, music, while participating in activities without the requirement of annoying ear buds or head phones. Further, the vest allows the user to receive ambient noise as well as the music.

In an illustrative embodiment, a vest including hardwired speakers and a waterproof pocket is disclosed herein. The vest may be a Coast Guard approved or non-Coast Guard approved personal flotation device. The vest may include one or more foam pads that provide flotation and/or protection from impact. The speakers may be waterproof and integrated into the shoulders of the vest. The speakers include wires configured to electrically connect to one or more electronic devices. The electronic device(s) is typically stored within the waterproof pocket. The wires may be run internally through the vest, for example, from the shoulders down a back and around a side of the vest to the waterproof pocket.

In an illustrative embodiment, the electronic device(s) includes an amplifier configured to be contained within the waterproof pocket. The amplifier includes one or more audio or media plugs configured to connect to a handheld media device, for example, an MP3 player, and receive a media transmission from the handheld media device. Similarly, the speakers include one or more plugs configured to connect to the handheld media device and/or the amplifier, and receive a media transmission from the handheld media device and/or amplifier. For example, when the speakers are electrically connected to the amplifier, and the amplifier is electrically connected to the handheld media device, the amplifier drives the two (2) speakers via input from the handheld media device.

Alternately, the handheld media device may include an integral amplifier or may be otherwise configured to generate a suitably strong signal to drive the associated speakers without need for a separate amplifier.

In an illustrative embodiment, the vest disclosed herein provides a user with a device that allows the user to connect a personal handheld media device, for example, a handheld digital audio player, communication device, media player, or computing devices, such as an MP3 player, a smart-phone, a mobile phone, or a PDA (personal digital assistant), to the amplifier or speakers and listen to audio transmissions hands free while participating in various sporting activities, for example, snowboarding, wakeboarding, skateboarding, running, swimming, kayaking, climbing, hiking, biking, surfing, horse riding, whitewater river rafting, and other activities of the type.

In another illustrative embodiment, the vest may be used in conjunction with handheld communication devices, such as phones, walkie-talkies, radios and the like. For example, the vest may be used in conjunction with such devices and thus serve as a one way communication device for instruction during sports training, military training, or other activities. In another illustrative embodiment, the vest may include a microphone positioned proximate to the user's mouth. In conjunction with any number of communication devices, the vest may be functionally associated with one or more such devices so as to be used as a two way communication device.

In one possible configuration, the personal flotation device may include a vest having a front portion, a back portion, and a top opening. The personal flotation device may include a front flotation pad positioned internally within the front portion of the vest, a back flotation pad positioned internally within the back portion of the vest, and a waterproof pocket on the front portion of the vest. The personal flotation device may further include a first waterproof speaker assembly removably connected to the vest in proximity to the top opening of the vest, and a second waterproof speaker assembly removably connected to the vest in proximity to the top opening of the vest, wherein the first waterproof speaker assembly and the second waterproof speaker assembly are wired internally within the vest to the waterproof pocket.

In this illustrative embodiment, the first and second waterproof speaker assemblies may include a first housing, a second housing, and a speaker positioned between the first housing and the second housing, wherein the first housing is configured to connect to the second housing. The second housing may include a recess configured to receive and cover a back portion of the speaker, and a waterproof seal seals the back portion of the speaker in the recess. The second housing is positioned on an internal side of an outer material layer of the vest, and the first housing is positioned on an external side of the outer material layer of the vest, wherein the first housing connects to the second housing through the outer material layer of the vest.

The personal flotation device may further include an accessible waterproof enclosure configured to be housed in the waterproof pocket. The waterproof enclosure includes a grommet configured to receive wire and carry the wire through the waterproof enclosure to an interior of the waterproof enclosure. One or more electronic devices may be housed in the waterproof pocket and are configured to electrically connect to the first waterproof speaker assembly and the second waterproof speaker assembly.

In an illustrative embodiment, a flotation vest including an outer material layer and an inner material layer is disclosed herein. The flotation vest may include a first housing positioned on an exterior surface of the outer material layer of the flotation vest, a second housing having an inner recess and positioned on an interior surface of the outer material layer of the flotation vest and connected to the first housing, and a speaker positioned between the first housing and the second housing.

In this illustrative embodiment, a front portion of the speaker may be positioned proximal to the first housing and a back portion of the speaker may be sealed in the inner recess of the second housing. A wire may be electrically connected to the back portion of the speaker and extend through the second housing. A waterproof seal may be placed on the second housing where the wire extends out of the second housing. The wire may extend from the speaker to the waterproof pocket, between the outer material layer and the inner material layer of the vest. Additionally, the flotation vest may include an amplifier positioned within the waterproof pocket and electrically connected to the wire. The amplifier may further be configured to electrically connect to a media player or a communication device.

BRIEF DESCRIPTION OF THE DRAWINGS

Certain embodiments of the systems, methods, and apparatuses disclosed herein are illustrated in the figures of the accompanying drawings which are meant to be exemplary and not limiting, in which like references are intended to refer to like or corresponding parts, and in which.

DETAILED DESCRIPTION

Figure 1:
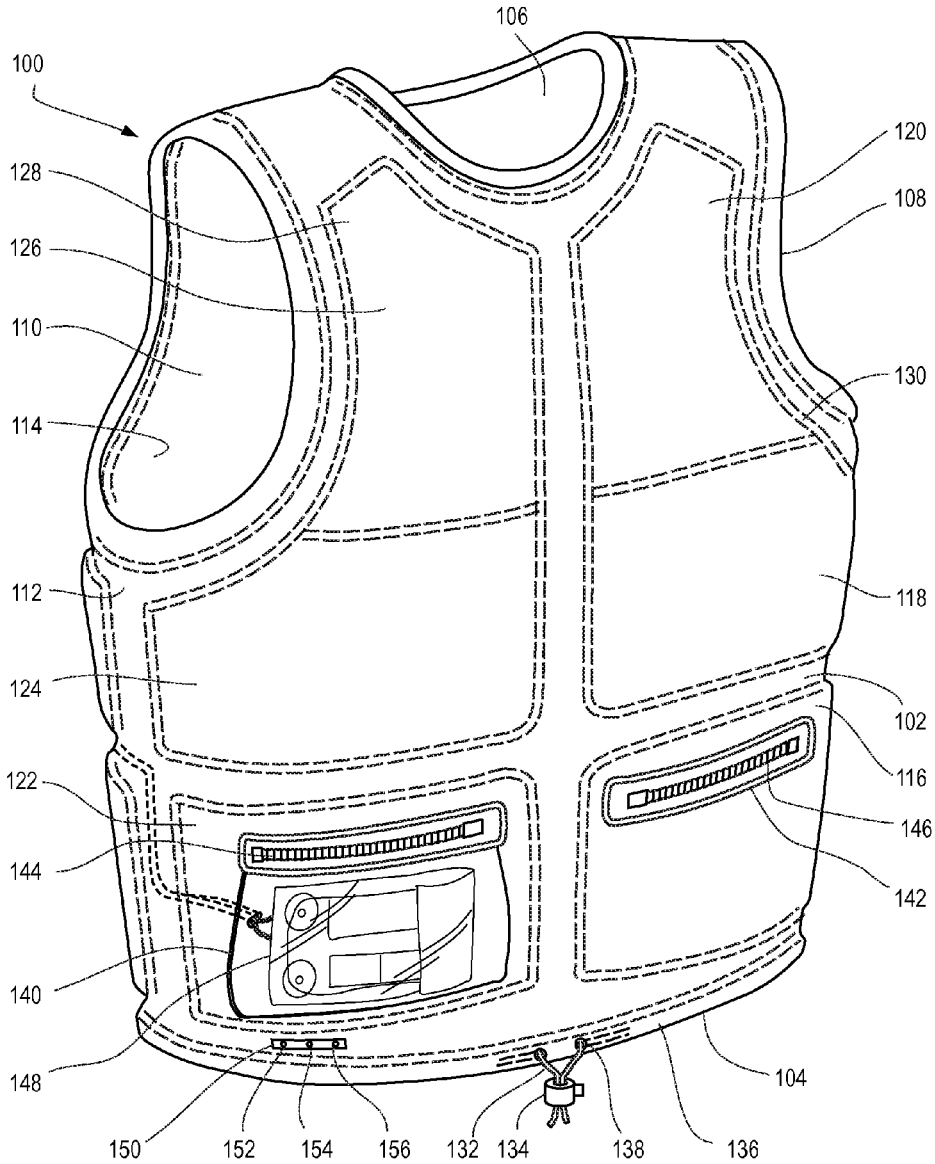
FIG. 1 illustrates a front view of an embodiment of a vest.

Detailed embodiments of systems, methods, and apparatuses are disclosed herein, however, it is to be understood that the disclosed embodiments are merely exemplary of the systems, methods, and apparatuses disclosed herein, which may be embodied in various forms. Therefore, specific functional details disclosed herein are not to be interpreted as limiting, but merely as a basis for the claims and as a representative basis for teaching one skilled in the art to variously employ the disclosure.

In an illustrative embodiment, a personal flotation device including hardwired waterproof speakers and one or more waterproof pockets is disclosed herein. The personal flotation device may be a vest, for example, a Coast Guard approved or non-Coast Guard approved flotation vest. The vest may include one or more foam pads that provide flotation and/or protection from impact. The waterproof speakers may be integrated into the shoulders of the vest, for example, in the shoulders on a front or a back of the vest. The speakers may be wired internally through the vest to the waterproof pocket, in which an amplifier and/or a handheld media device may be stored.

A vest 100 according to an illustrative embodiment is described with reference to FIGS. 1 and 2. As illustrated, the vest 100 includes a front portion 102 and a back portion 200, a bottom opening 104, a top or head and neck opening 106, a left side or left arm opening 108, and a right side or right arm opening 110. In an illustrative embodiment, the vest includes an outer material layer 112 and an inner material layer 114, which form the front portion 102 and the back portion 200.

The outer material layer 112 and the inner material layer 114 may each be a single piece of material or composed of more than one piece of material. The outer material layer 112 and the inner material layer 114 may also be shaped to form the openings, including the bottom opening 104, the top opening 106, the left side opening 108, and the right side opening 110. For example, the outer material layer 112 and the inner material layer 114 may be aligned with respect to each other and/or attached to each other, folded forming the front portion 102 and the back portion 200, and attached or connected on one side, for example, by stitching the front portion 102 to the back portion 200 from the left side opening 108 to the bottom opening 104, from the left side opening 108 to the top opening 106, and from the right side opening 110 to the top opening 106. In another illustrative embodiment, the front portion 102 and the back portion 200 may be composed of two (2) or more separate portions attached or connected together, for example, sewn together using thread or other stitching of the type.

In an illustrative embodiment, the vest 100 may include one or more flotation or impact pads positioned in an interior of the vest 100 between the outer material layer 112 and the inner material layer 114. As illustrated in FIGS. 1 and 2, the vest 100 includes six (6) front flotation pads and six (6) back flotation pads. The six (6) front flotation pads include a front left lower flotation pad 116, a front left middle flotation pad 118, a front left upper flotation pad 120, a front right lower flotation pad 122, a front right middle flotation pad 124, and a front right upper flotation pad 126. The six (6) back flotation pads include a back left lower flotation pad 202, a back left middle flotation pad 204, a back left upper flotation pad 206, a back right lower flotation pad 208, a back right middle flotation pad 210, and a back right upper flotation pad 212.

The front flotation pads 116-126 are positioned between the outer material layer 112 and the inner material layer 114 and secured in place to prevent the front flotation pads 116-126 from moving, shifting, or sliding within the interior of the vest 100. Similarly, the back flotation pads 202-212 are positioned between the outer material layer 112 and the inner material layer 114 and secured in place to prevent the back flotation pads 202-212 from moving, shifting, or sliding within the interior of the vest 100. As illustrated in FIGS. 1 and 2, each of the front flotation pads 116-126 and the back flotation pads 202-212 are secured in place by stitching 130 extending around the edges of each of the front flotation pads 116-126 and the back flotation pads 202-212, for example, edge 128 of the front right upper flotation pad 126. Although, the front flotation pads 116-126 and the back flotation pads 202-212 may be secured by, for example, but not limited to, adhesives, fasteners, and other securing means of the type. Additionally, the front flotation pads 116-126 and the back flotation pads 202-212 may be positioned between the outer material layer 112 and the inner material layer 114 without securing the front flotation pads 116-126 and the back flotation pads 202-212 in place.

Referring to FIG. 1, in an illustrative embodiment, the vest 100 may include a drawstring 132 and an adjustment clamp 134. The drawstring 132 may be threaded through a channel 136 extending around the bottom opening 104 of the vest 100 and the drawstring 132 exits the channel 136 through apertures 138. The channel 136 may be sewn or stitched into the vest 100. The drawstring 136 allows for the size of the bottom opening 104 to be adjusted. For example, the user or wearer of the vest 100 may tighten the drawstring 136, in effect decreasing the size of the bottom opening 104, to fit the user's waist. The adjustment clamp 134 receives the both ends of the drawstring 132 and adjustably clamps the drawstring 132, holding the drawstring 132 in a desired position, allowing the user to secure and release the tightness of the drawstring 132. Although, the vest 100 is described as including the drawstring 136 to alter the size of the bottom opening 104, the size of the bottom opening 104 may be altered or adjusted using other types of devices, for example, but not limited to an elastic material, a belt, and other devices of the type.

In an illustrative embodiment, the vest 100 includes one or more pockets in or on an exterior of the front portion 102, for example in or on the outer material layer 112. As illustrated in FIG. 1, the vest 100 includes a first pocket 140 and a second pocket 142. The first pocket 140 is positioned on a lower right portion of the front portion 102 in approximately the same location as the front right lower flotation pad 122, and the second pocket 142 is positioned on a lower left portion of the front portion 102 in approximately the same location as the front left lower flotation pad 116.

Figure 3:
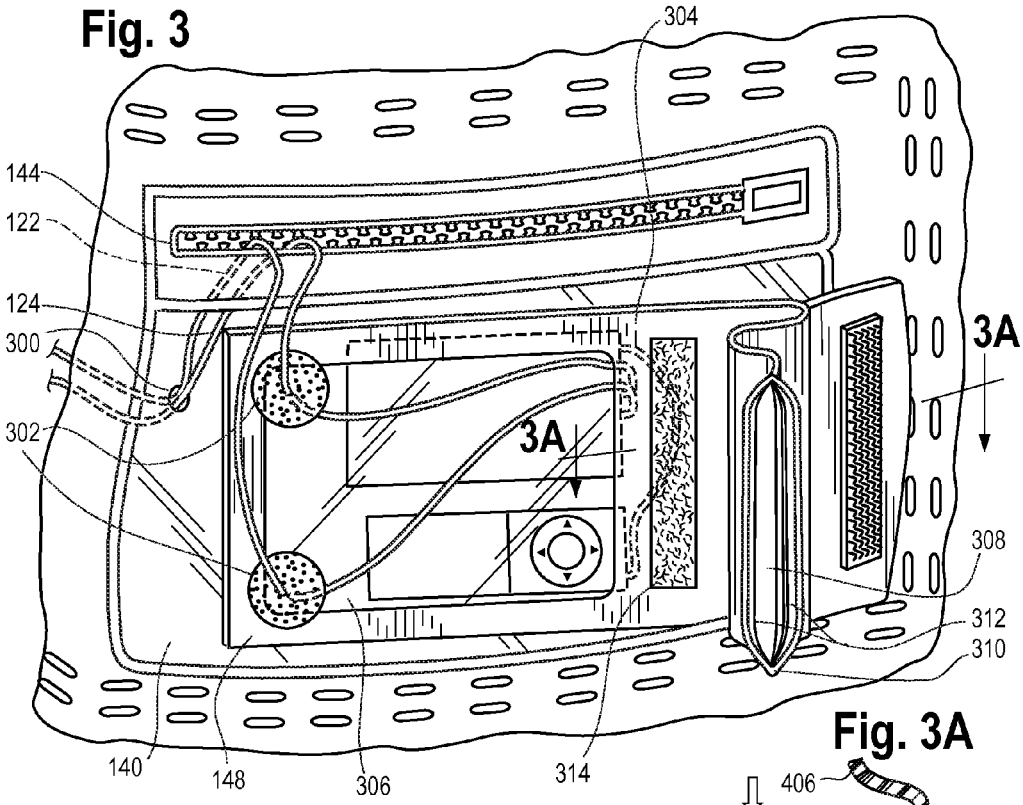
FIG. 3 illustrates a pocket and a removable waterproof enclosure of the vest illustrated in FIG. 1.

Referring to FIGS. 1 and 3, the first pocket 140 is waterproof and includes a first waterproof closure 144 on a top portion of the first pocket 140 configured to prevent water from entering the first pocket 140. As illustrated in FIG. 1, the first waterproof closure 144 is a waterproof zipper. The first pocket 140 may be constructed of a clear flexible waterproof plastic material. In other illustrative embodiments, the front portion of the first pocket 140 is constructed of the clear flexible waterproof plastic material and the back portion is constructed of another waterproof material, for example neoprene. Although the first waterproof closure 144 is described as a waterproof zipper, other waterproof closures may be used, for example, but not limited to, ziplock type closures, and other waterproof closures of the type.

Referring to FIG. 1, the second pocket 142 may be waterproof, water resistant, or non-waterproof. In an illustrative embodiment, the second pocket 142 is water resistant and includes a second closure 146 on a top portion of the second pocket 142. As illustrated in FIG. 1, the second closure 146 is a waterproof zipper. Although the second closure 146 is described as a waterproof zipper, other closures may be used, for example, but not limited to, non-waterproof zipper closures, buttons, snaps, hook-and-loop fasteners, such as Velcro, ziplock type closures, and other closures of the type.

In an illustrative embodiment, the second pocket 142 is integrated into the outer material layer 112 of the vest 100. In this embodiment, the second pocket 142 is located between the outer material layer 112 and the front left lower flotation pad 116. The second pocket 142 may open directly into the space between the outer material layer 112 and the front left lower flotation pad 116, or may include a lining material separating an interior of the second pocket 142 from the outer material layer 112 and the front left lower flotation pad 116.

Referring to FIG. 1, in an illustrative embodiment, the vest may include one or more accessible waterproof enclosures 148 configured to house or store one or more electronic devices. As illustrated in FIG. 1, the waterproof enclosure 148 may be housed within the first pocket 140. However, the waterproof enclosure 148 may be housed in the second pocket 142, or there may be two (2) separate waterproof enclosures 148, one housed in each of the first pocket 140 and the second pocket 142.

In an illustrative embodiment, the vest 100 includes one or more speakers integrated into and wired internally through the vest 100 to the first pocket 140. As illustrated in FIG. 2, the vest 100 includes two (2) speaker assemblies, which are described in further detail below, including a first speaker assembly 214 and a second speaker assembly 216. The first speaker assembly 214 and the second speaker assembly 216 may be located in proximity to the top opening 106 of the vest 100.

In an illustrative embodiment, the first speaker assembly 214 is located on a right shoulder portion 218 of the back portion 200 of the vest 100, and the second speaker assembly 216 located on a left shoulder portion 220 of the back portion 200 of the vest 100. Each of the first speaker assembly 214 and the second speaker assembly 216 may be electrically connected to one or more electronic devices, which may be housed in the first pocket 140. In an illustrative embodiment, the first speaker assembly 214 and the second speaker assembly 216 include wires or wiring 222 and 224, respectively. The wires 222 and 224 are configured to electrically connect the first speaker assembly 214 and the second speaker assembly 216, respectively, to the one or more electronic devices. The wires 222 and 224 may also be coated with a waterproof coating to prevent water or other liquid from damaging the wires 222 and 224.

Figure 2:
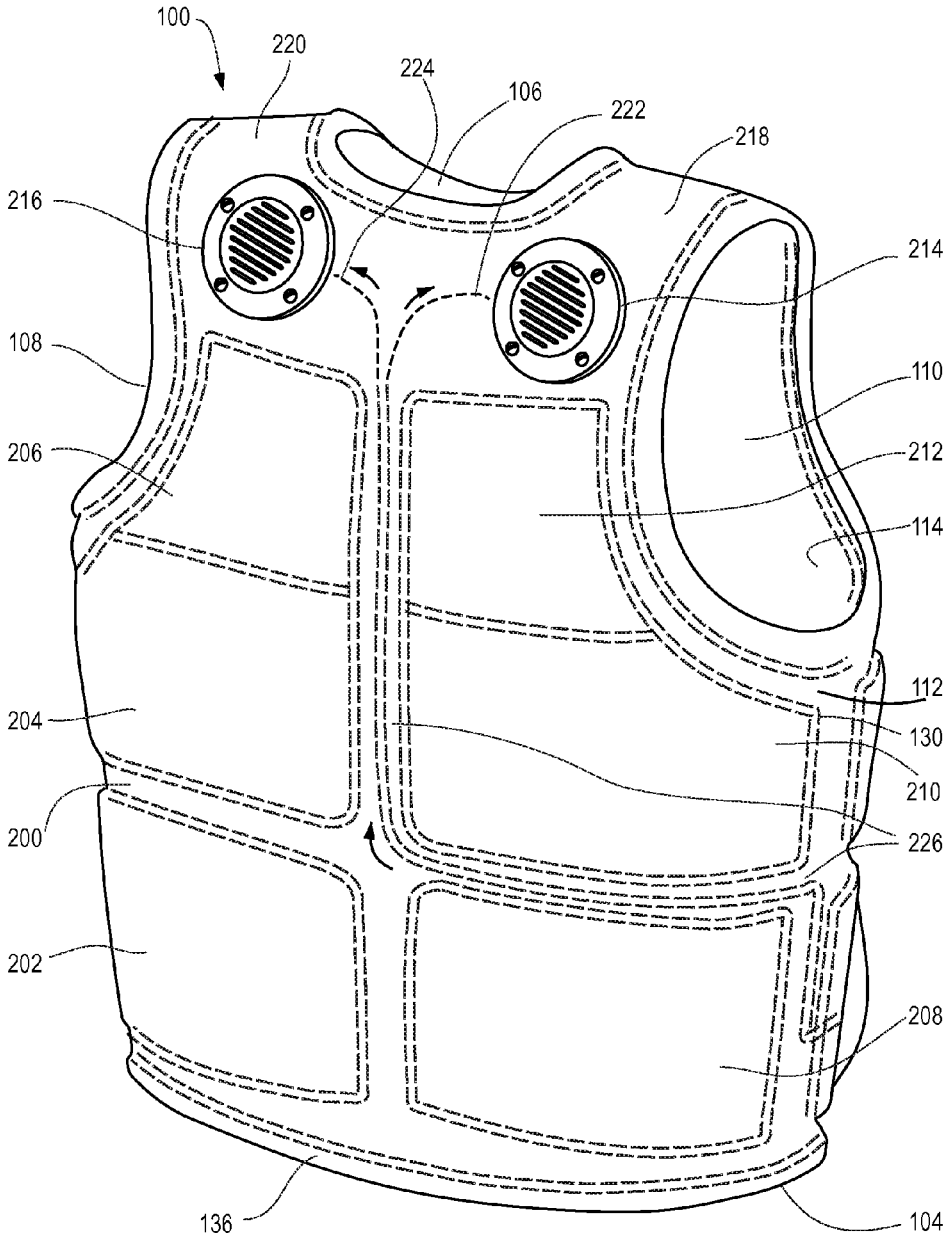
FIG. 2 illustrates a back view of the vest illustrated in FIG. 1.

As illustrated in FIGS. 1 and 2, the wires 222 and 224 are located between the outer material layer 112 and the inner material layer 114 of the vest 100, and extend through an internal channel 226, between the outer material layer 112 and the inner material layer 114 of the vest 100. Referring to FIGS. 1 and 2, the internal channel 226 extends from the first speaker assembly 214 and the second speaker assembly 216, vertically down the back portion 200 in a location between the back left flotation pads 204 and 206 and the back right flotation pads 210 and 212, horizontally in a location between the back right lower flotation pad 208 and the back right middle flotation pad 210, to the front portion 102 and to the first pocket 140. The wires 222 and 224 extend through the internal channel 226 and exit the internal channel 226 into the first pocket 140.

An enlarged view of the first pocket 140 and the waterproof enclosure 148 according to an illustrative embodiment is described with reference to FIG. 3. As illustrated in FIG. 3, the wires 222 and 224 extend into a back of the first pocket 140 through one or more apertures 300. Although the first pocket 140 is described as including aperture 300, the first pocket 140 may include one aperture 300 or more than one aperture 300. For example, the wires 222 and 224 may extend into the first pocket 140 through one aperture 300 or the each of the wires 222 and 224 may extend into the first pocket 140 through separate apertures 300. Further, the aperture(s) 300 may include waterproof seals, for example, but not limited to, grommets or other sealing mechanisms of the type, that are configured to receive the wires 222 and 224 and prevent water or other liquid from entering into the first pocket 140 via the aperture(s) 300.

In an illustrative embodiment, the wires 222 and 224 extend from inside of the first pocket 140 into the waterproof enclosure 148. As illustrated in FIG. 3, the waterproof enclosure 148 includes grommets 302. The grommets 302 are located on a front 304 of the waterproof enclosure 148, near the corners of the waterproof enclosure 148, and extend from and exterior of the waterproof enclosure 148 into an interior of the waterproof enclosure 148. Although, the grommets 302 may be located in or on other portions of the waterproof enclosure 148, for example, but to limited to a back of the waterproof enclosure 148.

The wires 222 and 224 extend into the waterproof enclosure 148 via the grommets 302. The grommets 302 are configured to create a waterproof seal around the wires 222 and 224 that allows the wires 222 and 224 to enter the waterproof enclosure 148 and prevents water or other liquid from entering the waterproof enclosure 148. In an illustrative embodiment, the grommets 302 are rubber grommets infused with a sealant. It should be appreciated by those skilled in the art that waterproof sealing mechanisms and sealants, for example, silicone based sealants, epoxy sealants, and other sealants may be used that allow the wires 222 and 224 to enter the waterproof enclosure 148 and prevent water or other liquid from entering the waterproof enclosure 148.

As illustrated in FIG. 3, the waterproof enclosure 148 may include a clear viewing portion 306 on the front 304 of the waterproof enclosure 148. The waterproof enclosure 148 includes an opening 308 extending across a top portion 310 of the waterproof enclosure 148. In an illustrative embodiment, the top portion 310 of the waterproof enclosure 148 includes a waterproof closure 312. As illustrated in FIG. 3, the waterproof closure 312 is a ziplock type closure, however it should be appreciated by those skilled in the art that other waterproof closures may be used, for example, but not limited to a waterproof zipper.

The clear viewing portion 306 and the clear first pocket 140 may allow for a user to view and control a device having touchpad controls, for example, but not limited to, a handheld digital audio player, a communication device, a media player, and a computing device, for example, a MP3 player, a smartphone, a mobile phone, a PDA, and other devices of the type, housed within the first pocket 140 and/or the waterproof enclosure 148 without removing the device from the first pocket 140 and/or the waterproof enclosure 148.

Figure 3A:
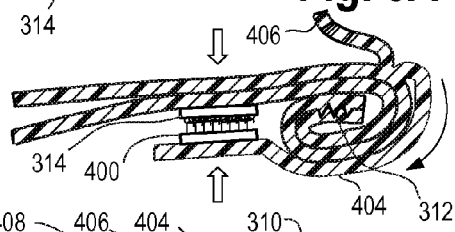
FIG. 3A illustrates a cut away view of the removable waterproof enclosure in a closed position.
Figure 4:
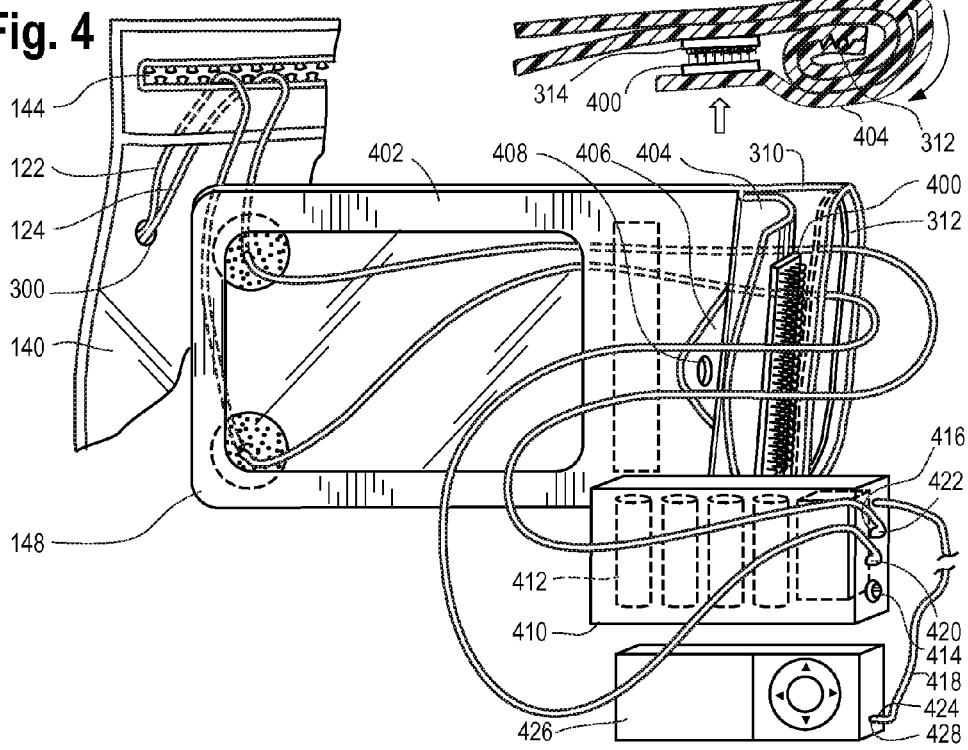
FIG. 4 illustrates a back view of the waterproof enclosure illustrated in FIG. 3.

Referring to FIGS. 3 and 4, in an illustrative embodiment, the waterproof enclosure 148 includes a first fastener 314 on the front 304 of the waterproof enclosure 148 and a second fastener 400 on a back 402 of the waterproof enclosure 148. As illustrated in FIGS. 3 and 4, the first fastener 314 and the second fastener 400 are hook-and-loop fasteners, for example Velcro, configured to mate with one another. Referring to FIG. 4, the waterproof enclosure 148 includes a protruding portion 404 or flap extending from the back 402 of the waterproof enclosure 148, and the second fastener 400 is located on the protruding portion 404. Referring to FIGS. 3, 3A, and 4, the waterproof enclosure 148 may be closed by closing the waterproof closure 312 on the top portion 310 of the waterproof enclosure 148, rolling or folding the top portion 310 downward, and securing the second fastener 400 to the first fattener 314 over the top portion 310.

As illustrated in FIG. 4, the waterproof enclosure 148 may also include a connection portion 406 extending from the back 402 of the waterproof enclosure 148 below the protruding portion 404. The connection portion 406 may include one or more apertures 408 that may be used to secure the waterproof enclosure 148 to the vest 100, for example, to the interior of the first pocket 140.

Referring to FIG. 4, the vest 100 may include one or more electronic devices. As illustrated, the vest 100 includes an electronic device 410, which may be an amplifier configured to amplify or increase volume to the speakers. The electronic device 410 or amplifier is configured to connect to the speaker wires 222 and 224, and be housed within the waterproof enclosure 148. The electronic device 410 or amplifier may include a power source 412, a power on/off switch 414, one or more audio connection ports 416, and an input connection wire 418. The electronic device 410 or amplifier may also include one or more additional connection ports, for example, but not limited to one or more Universal Serial Bus (USB) ports, and power input ports.

In an illustrative embodiment, the power source 412 of the electronic device 410 or amplifier includes one or more batteries internally positioned within the electronic device 410 or amplifier. As illustrated in FIG. 4, the one or more batteries include four (4) replaceable AA batteries, which may be rechargeable or non-rechargeable. Although the power source 412 is described as being four (4) AA batteries, the power source 412 may be one or more replaceable or non-replaceable rechargeable or non-rechargeable batteries that may be internally positioned within the electronic device 410 or amplifier for example, but not limited to, one or more alkaline batteries, lithium ion or other lithium based batteries, nickel based batteries, and other rechargeable batteries of the type. Further, although the power source 412 is described as being internal to the electronic device 410 or amplifier, the electronic device 410 or amplifier may alternatively include an external power source configured to electrically connect to the electronic device 410 or amplifier.

When the power source 412 is rechargeable, the electronic device 410 or amplifier may include one or more power input ports, for example the USB or other power input port configured to electrically connect the electronic device 410 or amplifier to an external power source, for example a wall outlet or other power outlet, and recharge the power source 412.

The power on/off switch 414 may be configured to turn on and off the electronic device 410 or amplifier. In an illustrative embodiment, when the electronic device 410 or amplifier is in a power on mode, a light is activated on the electronic device 410 or amplifier indicating the power is on. In an illustrative embodiment, the light is a blue light; however, it should be appreciated by those skilled in the art that the light may be any color light.

In an illustrative embodiment, the speaker wires 222 and 224 may each include an audio connection plug 420 and 422, respectively, configured to electrically connect to the one or more audio connection ports 416 of the electronic device 410 or amplifier. In another illustrative embodiment, the speaker wires 222 and 224 are combined and both of the speaker wires 222 and 224 terminate in a single audio connection plug 420 or 422. Although the one or more audio connection plugs 420 and 422 are described as being configured to electrically connect to the one or more audio connection ports 416 of the electronic device 410 or amplifier, the one or more audio connection plugs 420 and 422 may be configured to electrically connect to an audio connection port of another electronic device, for example, but not limited to handheld digital audio players, communication devices, media players, and computing devices, for example, MP3 players, smart-phones, mobile phones, PDAs, and other devices of the type.

In an illustrative embodiment, the one or more audio connection plugs 420 and 422 and the one or more corresponding audio connection ports 416 may be, for example, but not limited to, standard 3.5 mm audio plugs and ports, 2.5 mm audio plugs and ports, 6.35 mm audio plugs and ports, and other audio plugs and corresponding ports of the type.

In an illustrative embodiment, the input connection wire 418 of the electronic device 410 or amplifier includes an input connection plug 424. The input connection plug 424 is configured to electrically connect the electronic device 410 or amplifier to another electronic device 426, which may be a media and/or communication device, for example, but not limited to, handheld digital audio players, communication devices, media players, and computing devices, for example, MP3 players, smart-phones, mobile phones, PDAs, and other devices of the type. In an illustrative embodiment, the input connection plug 424 and the corresponding connection port 428 of the electronic device 426 may be, for example, but not limited to, a standard 3.5 mm connection plug and port, 2.5 mm connection plug and port, 6.35 mm connection plug and port, and/or other audio or media connection plugs and corresponding ports of the type.

Figure 5:
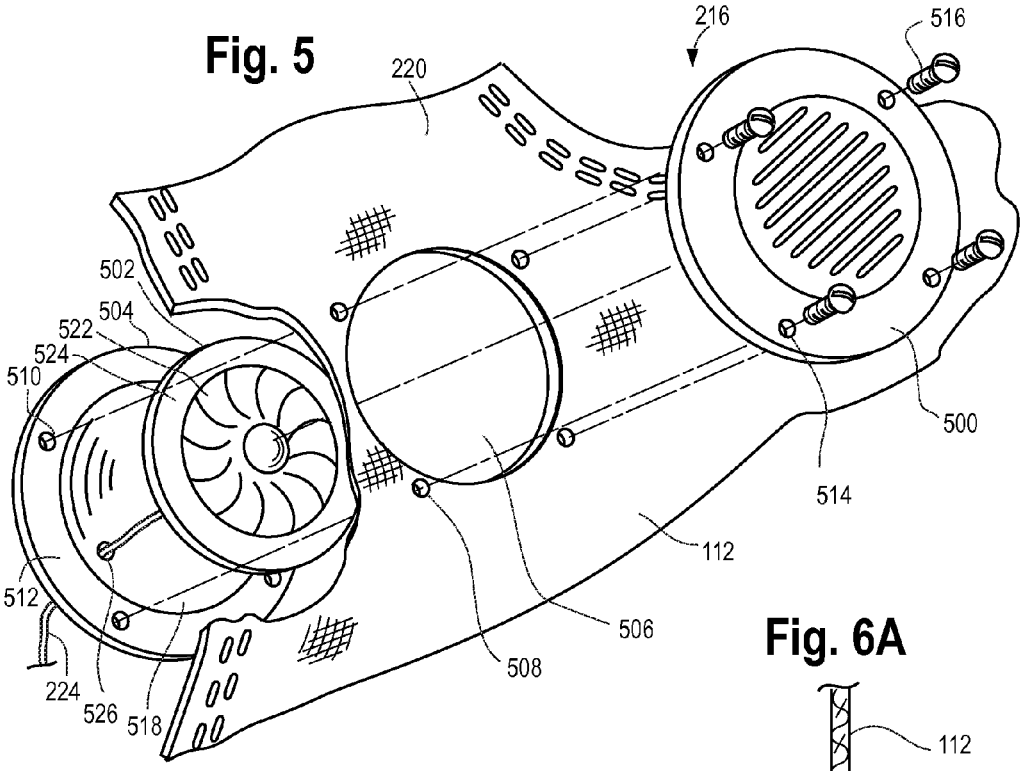
FIG. 5 illustrates a speaker assembly of the vest illustrated in FIG. 2.
Figure 6:
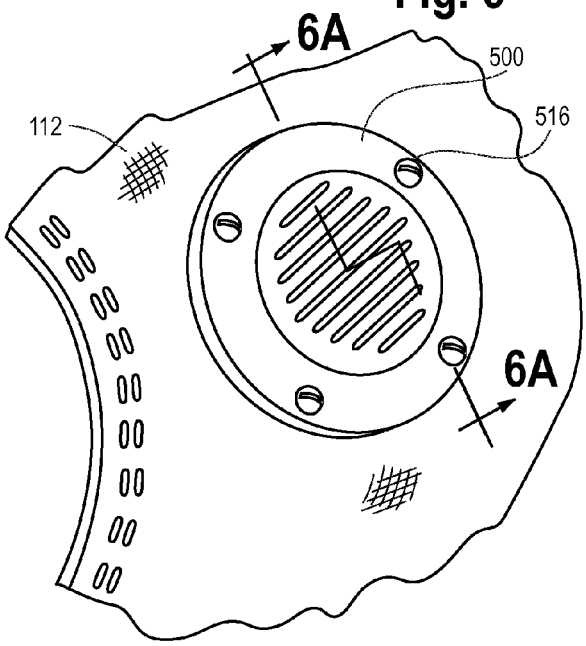
FIG. 6 illustrates the speaker assembly illustrated in FIG. 5.
Figure 6A:
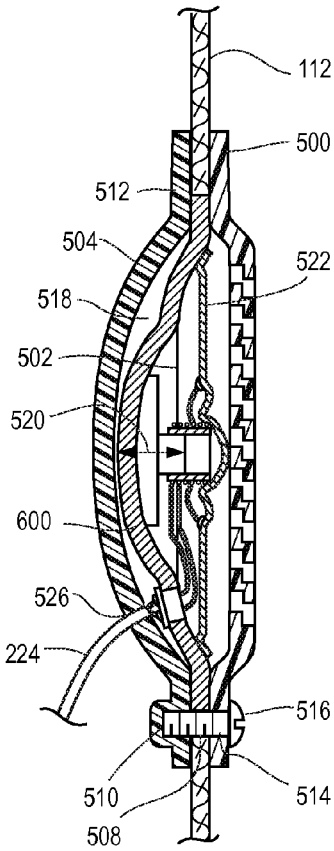
FIG. 6A illustrates a cut away view of the speaker assembly illustrated in FIGS. 5 and 6.

An enlarged view of the second speaker assembly 216 according to an illustrative embodiment is described with reference to FIGS. 5-6A. As illustrated in FIGS. 5-6A, the second speaker assembly 216 includes a first housing 500, a speaker 502, and a second housing 504. The vest 100 includes a speaker aperture 506 in the outer material layer 112 on the left shoulder portion 220 of the vest 100, and one or more connection apertures 508 around a periphery of the speaker aperture 506.

In an illustrative embodiment, the second housing 504 includes one or more internally threaded portions 510 on an outer portion 512, which may be internally threaded blind holes. The second housing 504 is positioned between the outer material layer 112 and the inner material layer 114 of the vest 100 and the internally threaded portions 510 are aligned with the connection apertures 508 of the vest 100. The first housing 500 includes one or more fastener apertures 514 configured to align with the internally threaded portions 510 of the second housing 504 and the connection apertures 508 of the vest 100. The speaker 502 is positioned between the first housing 500 and the second housing 504 in the speaker aperture 506 of the vest 100. The first housing 500 and the second housing 504 are secured together by one or more fasteners 516 configured to mate with the internally threaded portions 510 of the second housing 504. As illustrated, the one or more fasteners 516 extend through the fastener apertures 514 of the first housing 500, through the connection apertures 508 of the vest 100, and into the internally threaded portions 510 of the second housing 504 to secure the second speaker assembly 216 to the vest 100.

As illustrated, there are four (4) fastener apertures 514, fasteners 516, internally threaded portions 510, and connection apertures 508. However, there may be less than four (4) or more than four (4) fastener apertures 514, fasteners 516, internally threaded portions 510, and connection apertures 508, for example, but not limited to two (2), three (3), five (5), six (6), and other numbers of fastener apertures 514, fasteners 516, internally threaded portions 510, and connection apertures 508. The one or more fasteners 516 may be, for example, but not limited to, allen screws, crosshead screws, flathead screws, hexhead screws, bolts, and other fasteners of the type.

In another illustrative embodiment, instead of the fastener apertures 514 and the internally threaded portions 510, the first housing 500 may include one or more prongs having a protrusion on a terminal end, and the second housing 504 may include mating connections configured to receive the prongs of the first housing 500 to secure the second speaker assembly 216 to the vest 100. In another illustrative embodiment, instead of the fastener apertures 514 and the internally threaded portions 510, one of the first housing 500 and the second housing 504 may include a male threaded portion and the other of the first housing 500 and the second housing 504 may include a female threaded portion configured to mate with the male threaded portion to secure the second speaker assembly 216 to the vest 100. In this illustrative embodiment, the vest 100 may not include the connection apertures 508 of the vest 100.

In an illustrative embodiment, the first housing 500 is a grate, and the second housing 504 includes an inner recess 518 having a depth 520 configured to receive and cover a back portion 600 of the speaker 502. The back portion 600 of the speaker 502 is positioned within the inner recess 518 of the second housing 504 and the speaker 502 is sealed to the second housing 504 to prevent water or other liquid from entering the inner recess 518 of the second housing 504 and contacting the back portion 600 of the speaker 502, creating a waterproof speaker assembly. The speaker 502 may be sealed to the second housing 504 using one or more waterproofing sealants, for example, but not limited to, adhesives, silicone based sealants, epoxy sealants, and other waterproofing sealants of the type. The speaker 502 may also include a waterproof layer 522 on or forming a front 524 of the speaker 502 configured to prevent water or other liquid from contacting the internals of the speaker 502.

In an illustrative embodiment, the wire 224 enters the second housing 504 through an aperture 526 in the inner recess 518 of the second housing 504 and is electrically connected to the speaker 502. The wire 224 is electrically connects to the speaker 502 within the inner recess 518 of the second housing 504. The aperture 526 in the inner recess 518 and wire 224 extending through the aperture 526 is also sealed to prevent water or other liquid from entering the inner recess 518 of the second housing 504 and contacting the back portion 600 of the speaker 502. The aperture 526 may be sealed using one or more waterproofing sealants, for example, but not limited to, adhesives, silicone based sealants, epoxy sealants, and other waterproofing sealants of the type.

In an illustrative embodiment, the speaker 502, the second housing 504, and the wire 224 are configured to be replaceable or interchangeable as a unit. The first housing 500 may be removed from the vest 100 and the speaker 502, the second housing 504, and the wire 222 may be taken out of the vest 100. This allows for the speaker 502, the second housing 504, and the wire 224 to be replaced, for example, if the speaker 502 and/or wire 224 become damaged for any reason. In other illustrative embodiments, each of the speaker 502, the second housing 504, and the wire 224 may be configured to be replaced individually.

Although, the second speaker assembly 216 and wire 224 is illustrated and described, it should be appreciated by those skilled in the art that the first speaker assembly 214 and the second speaker assembly 216 may be the same speaker assembly, and the first speaker assembly 214 and wire 222 may include and be constructed in the same manner as the second speaker assembly 216 and wire 224.

Figure 7:
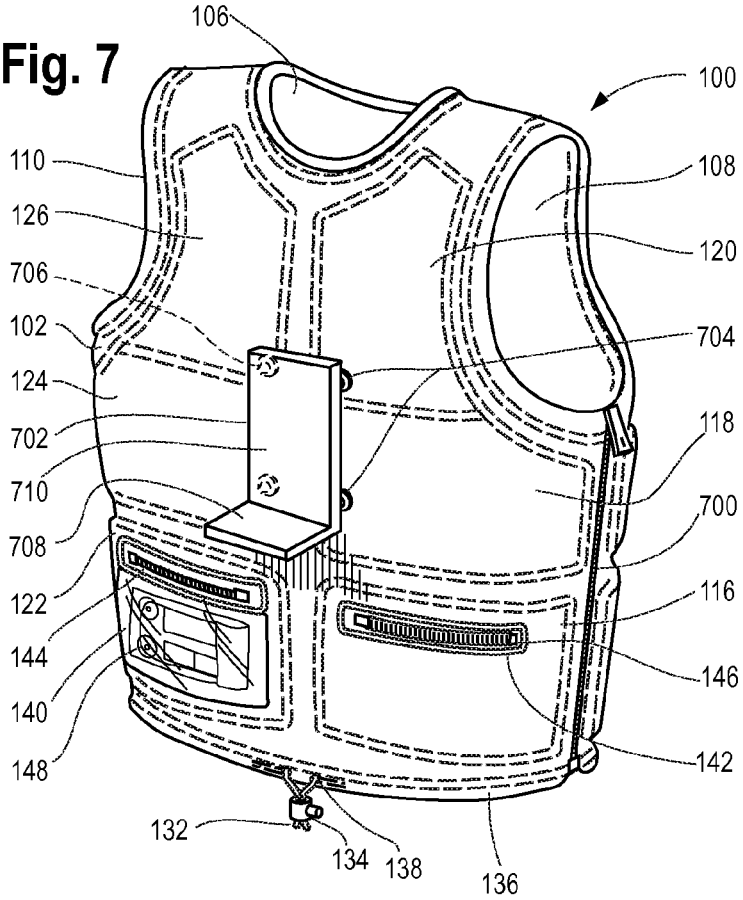
FIG. 7 illustrates a front view of an embodiment of a vest including a mounting bracket.

In an illustrative embodiment, referring to FIGS. 1 and 7, the vest 100 may include one or more additional features. As illustrated in FIG. 1, the vest 100 may include a waterproof control panel 150 electrically connected to the one or more devices 410 or amplifier, and/or one or more media and/or communication devices 426 housed within the first pocket 140 and/or the waterproof enclosure 148 in the first pocket 140. The waterproof control panel 150 may be located on the front portion 102 of the vest 100 and wired internally between the outer material layer 112 and the inner material layer 114 of the vest to the first pocket 140 and/or the waterproof enclosure 148 in the first pocket 140 in a similar matter as the speakers are wired. The waterproof control panel 150 may include control buttons, for example, including a volume increase button 152, a volume decrease button 154, a play and/or pause button 156, and other buttons, for example, but not limited to a power on/off button, a track selection button, and other buttons of the type. The control panel 150 may allow the user to manipulate the volume, audio track, and other controls of the device the waterproof control panel 150 is connected to without removing the device from the first pocket 140 and/or the waterproof enclosure 148 in the first pocket 140.

Referring to FIG. 7, the vest 100 may include a side opening/closure 700. As illustrated in FIG. 7, the side opening/closure 700 is a zipper configured to zip vertically up from the bottom opening 104 of the vest 100 to the left side opening 108 of the vest 100. Further, as illustrated in FIG. 7, the drawstring 132 is separated at the side opening/closure 700 and sewn to the vest 100 within the channel 136 proximal to the side opening/closure 700, allowing the side opening/closure 700 to be freely opened and closed. In another illustrative embodiment, the drawstring 132 and apertures 138 may be positioned on the left side of the vest 100.

Although the side opening/closure 700 is described as a zipper, the side opening/closure 700 may be for example, but not limited to, buttons, snaps, hook-and-loop fasteners, such as Velcro, and other closures of the type. Although the side opening/closure 700 is described as being on the left side of the vest 100, the side opening/closure 700 may be on the right side of the vest 100 or on both sides of the vest 100, and the internal wiring may be modified or re-routed within the vest 100 accordingly. In another illustrative embodiment, the vest 100 may include a front opening/closure that extends vertically from the bottom opening 104 of the vest 100 to the top opening 106 of the vest 100.

In an illustrative embodiment, the vest 100 may include a camera mount 702. In this illustrative embodiment, the vest 100 may include mounting connections 704 on the front portion 102 of the vest 100. As illustrated in FIG. 7, the mounting connections 704 are positioned on a center portion of the vest 100 and include four (4) snap fasteners. However, the mounting connections 704 may be positioned on the vest 100 in other locations, for example, but not limited to, anywhere on the front portion 102 and/or the back portion 200.

The camera mount 702 may be a removable "L" shaped bracket including mating mounting connections 706 on a back of the camera mount 702. The mating mounting connections 706 are configured to removably connect to the mounting connections 704 on the vest 100 to secure the camera mount 702 to the vest. A camera, for example, a waterproof wearable action camera may be mounted to the camera mount 702, for example, on a horizontal portion 708 and/or on a front vertical portion 710 of the camera mount 702 in a conventional manner. In an illustrative embodiment, the horizontal portion 708 has a length of about two (2) inches and a width of about three and one half (3½) inches, and the front vertical portion 710 has a length of about six (6) inches and a width of about three and one half (3½) inches. Although, it should be appreciated by those skilled in the art that the lengths and widths of the horizontal portion 708 and the vertical portion 710 of the camera mount 702 may be smaller or larger than those described herein.

Although the mounting connections 704 and mating mounting connections 706 are describes as four (4) snap fasteners, the mounting connections 704 and mating mounting connections 706 may include less than four (4) or more than four (4) mounting connections 704. Further, although the mounting connections 704 and mating mounting connections 706 are describes as snap fasteners, other connectors may be used, for example, but not limited to, bolts, buttons, screws, hook-and-loop fasteners, such as Velcro, and other fasteners of the type.

Although, certain embodiments have been described and illustrated herein, many modifications and variations may be made without departing from the spirit and scope of the disclosure. For example, the waterproof packets, enclosures, speakers and other components described above may be integrated into alternative vest styles and additional garments, for example, but not limited to wet suits, bulletproof vests, and other sports vests and garments.

Figure 8:
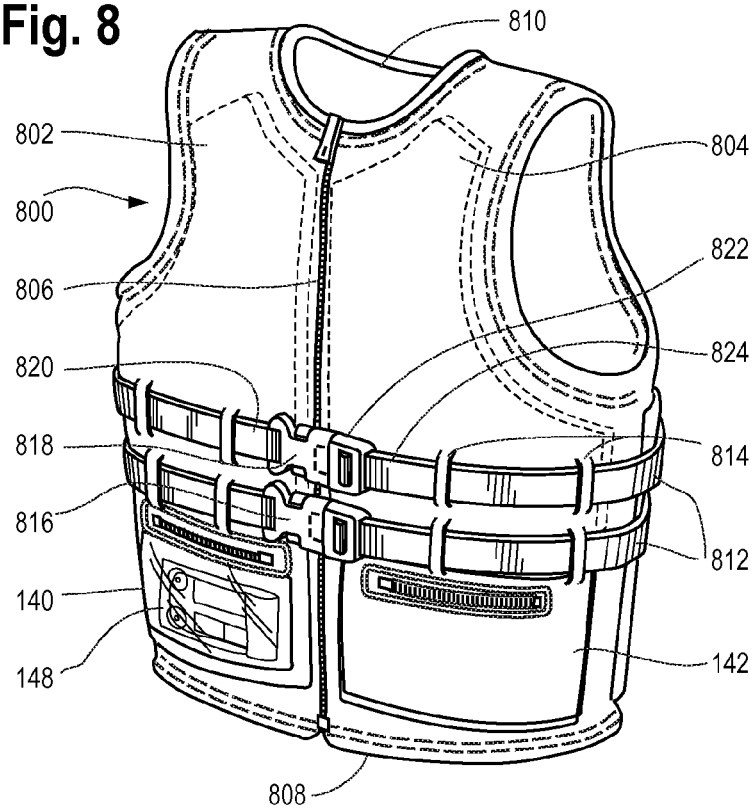
FIG. 8 illustrates a front view of an embodiment of a vest including a front opening and fastening straps.

One such alternative vest style according to an illustrative embodiment is described with reference to FIG. 8. A vest 800 may be substantially similar to the vest 100 described above and include one or more of any of the components as described with reference to vest 100. As illustrated in FIG. 8, the vest 800 includes the following modifications. The vest 800 includes two (2) front flotation or impact pads, including a front right flotation pad 802 and a front left flotation pad 804, and one (1) back flotation or impact pad positioned in an interior of the vest 800.

Further, the vest 800 includes a front opening/closure 806 that extends vertically from a bottom opening 808 of the vest 800 to a top opening 810 of the vest 800, and one or more adjustable straps 812 extending horizontally around the vest 800. As illustrated, the adjustable straps 812 are threaded through loops 814 on the vest 800 that are configured to hold the straps 812 in place. The adjustable straps 812 may further include adjustable closures 816 or buckles. The adjustable closures 816 or buckles may include female fasteners or clips 818 connected to first ends 820 of the straps 812 and mating male fasteners or clips 822 connected to second ends 824 of the straps 812. The adjustable closures 816 or buckles may allow the user to tighten and loosen the length straps to securely fasten the vest 800 around the user.

As described above, the vest 800 may include one or more of any of the components described with reference to vest 100. For example, the vest 800 may include the first pocket 104, second pocket 142, waterproof enclosure 148, speaker assemblies 214 and 216, electronic device 410, camera mount 702 and associated internal wiring and corresponding connections and/or fasteners.

In an illustrative embodiment, the vests 100 and/or 800 may further include one or more waterproof microphones configured to electrically connect to one or more two-way communication devices, which may be housed in the first pocket and/or the waterproof enclosure. The microphone(s) may be integrated into the vests 100 and/or 800 in a location in proximity to or near the top opening 106 and/or the top opening 810. The microphone(s) may be wired internally through the vests 100 and/or 800, the first pocket, and/or the waterproof enclosure to the two-way communication device(s) in a similar manner the speaker wires are wired into and through the vest 100 and/or 800, as describe above. In another illustrative embodiment, one of the speakers may be replaced or integrated with a microphone and be used for such two-way communication.

In an illustrative embodiment, the length of the wires or wiring disclosed herein should be longer than the direct distance between the starting points of the wires and the ending points of the wires to prevent the wires from pulling out of the devices they are electrically connected to and to allow for the unrestricted movement of the user of the vests 100 and/or 800. For example, the length of the wires or wiring disclosed herein may be about one (1) foot to about ten (10) feet, or longer.

In an illustrative embodiment, the vests 100 and 800 may further include one or more integrated waterproof solar panels to supply power to one or more of the electronic devices. For example, the solar panels may be positioned in any location on the vests 100 and/or 800, for example, on the front or back of the vests 100 and/or 800, and be wired internally through the vests 100 and/or 800, the first pocket, and/or the waterproof enclosure and electrically connect to one or more of the electronic devices that may be housed within the first pocket, and/or the waterproof enclosure.

In an illustrative embodiment, the vests 100 and 800 may be constructed of any suitable material. For example, the outer material layer 112 and the inner material layer 114 of the vest 100 may be constructed of one or more materials including, for example, but not limited to neoprene, nylon, one or more synthetic rubbers, and other materials of the type. It should be appreciated by those skilled in the art that various types of materials are suitable and may be used in the construction of the vests 100 and 800.

Further, one or more of the front flotation pads and the back flotation pads of the vests 100 and 800 may be shaped to coincide with the contours of the openings of the vest 100 and 800. For example, the front left upper flotation pad 120 and the front right upper flotation pad 126 may be shaped to follow the contours of the top opening 106 and the left side opening 108 and the right side opening 110 of the vest 100, respectively. Similarly, the front right flotation pad 802 and the front left flotation pad 804 may be shaped to follow the contours of the top opening 810 and the left and right side openings of the vest 800, respectively. Additionally, the back left upper flotation pad 206 and the back right upper flotation pad 212 may be shaped to follow the contours of the left side opening 108 and the right side opening 110, respectively. The front left middle flotation pad 118 and the back left middle flotation pad 204 may be shaped to follow the contours of the left side opening 108, and the front right middle flotation pad 124 and the back right middle flotation pad 210 may be shaped to follow the contours of the left side opening 108 and the right side opening 110. Similarly, the back flotation pad of the vest 800 may be shaped to follow the contours of the left side, right side, and top openings of the vest 800.

In an illustrative embodiment, the flotation or impact pads of the vests 100 and 800 may be constructed of one or more materials including, for example, but not limited to high density foam or high density flotation foam, foamed plastics or polymers, closed-cell foam, and other buoyant and impact materials of the type. It should be appreciated by those skilled in the art that various types of materials are suitable and may be used in the flotation or impact pads of the vests 100 and 800. Further, although, the vest 100 is described above as including six (6) front flotation pads and six (6) back flotation pads and the vest 800 is described above as including two (2) front flotation pads and one (1) back flotation pad, the vests 100 and 800 may include any number of flotation pads. For example, the vest 100 may include less that six (6) or more than six (6) front flotation pad and less that six (6) or more than six (6) back flotation pads, and various combinations thereof. Similarly, the vest 800 may include less two (2) or more than two (2) front flotation pad and more than one (1) back flotation pad, and various combinations thereof.

The use of the six (6) front flotation pads and the six (6) back flotation pads in the vest 100 may allow the vest 100 to flex, bend, and move with the movement of a user. It should be appreciated by those skilled in the art that, generally, the use of fewer flotation pads may further limit the ability of the vests 100 and 800 to flex, bend, and move with the movement of a user, and a larger number of flotation pads may increase the ability of the vests 100 and 800 to flex, bend, and move with the movement of a user.

Further, although the first pocket 140 is described as being constructed of a clear flexible waterproof plastic material and/or a combination of the clear flexible waterproof plastic material and another waterproof material, the first pocket 140 may be constructed of a non-clear material, and of other waterproof materials, for example, but not limited to plastics, polymers, synthetic rubbers, and other waterproof materials of the type. The second pocket 142 may also be constructed of any suitable material, for example, but not limited to, flexible waterproof plastic materials, flexible polymers, neoprene, nylon, synthetic rubbers, and other materials of the type.

Although the first pocket 140 and the second pocket 142 are described as being different types of pockets, the first pocket 140 may be the same as the second pocket 142 or the second pocket 142 may be the same as the first pocket 140. The vest 100 may include only one pocket, either the first pocket 140 or the second pocket 142. Further, although the first pocket 140 and the second pocket 142 are described and illustrated as being positioned on the front lower right and left portions of the vests 100 and 800, respectively, each of the first pocket 140 and/or the second pocket 142 may be positioned in alternative locations on the vests 100 and 800, and the wiring may be modified accordingly. For example, but not limited to, the first pocket 140 and the second pocket 142 may be positioned on the same side of the vests 100 and 800, and/or one or more of the first pocket 140 and the second pocket 142 may be positioned higher up on the vests 100 and 800.

Although the waterproof enclosure 148 is described as including grommets 302, the waterproof enclosure 148 may include one grommet 302 or more than one grommet 302. For example, the wires 222 and 224 may extend into the waterproof enclosure 148 through one grommet 302 or the each of the wires 222 and 224 may extend into the waterproof enclosure 148 trough separate grommets 302. In an illustrative embodiment, the waterproof enclosure 148 is any suitable structure for receiving the electronic device(s), for example, a pouch, a container, or a compartment, and may be constructed of one or more suitable materials, for example, but not limited to, rigid and/or flexible plastics, clear and/or non-clear materials, rigid and/or flexible polymers, synthetic rubbers, and other waterproof materials of the type.

In an illustrative embodiment, the electronic device 410 or amplifier is a high fidelity amplifier. Although, it should be appreciated by those skilled in the art that other amplifiers may be used.

In an illustrative embodiment, the speaker 502 is three (3) inches in diameter. Although, it should be appreciated by those skilled in the art that speakers having smaller or larger diameters may be used, for example, but not limited to, speakers having a diameter of one half (½) inch, one (1) inch, two (2) inches, three (3) inches, four (4) inches, five (5) inches, and other diameters suitable for integration into the vest 100. The first housing 500 and the second housing 504 may also be sized or resized accordingly.

Although the vests 100 and 800 are described as including the first speaker assembly 214 and the second speaker assembly 216, the vests 100 and 800 may include only one speaker assembly or more than two (2) speaker assemblies. Further, although the first speaker assembly 214 and the second speaker assembly 216 are described as being located on the right and left shoulder portions of the back of the vests 100 and 800, the first speaker assembly 214 and the second speaker assembly 216 may be located on other portions of the vests 100 and 800, for example, but not limited to, anywhere on the front portion and/or the back portion of the vests 100 and 800, and the wiring may be modified accordingly.

Although the systems, methods, and apparatuses disclosed herein have been described and illustrated in connection with certain embodiments, many variations and modifications will be evident to those skilled in the art and may be made without departing from the spirit and scope of the disclosure. The disclosure is thus not to be limited to the precise details of methodology or construction set forth above as such variations and modification are intended to be included within the scope of the disclosure.

What is claimed is:

1. A flotation device comprising:

a waterproof speaker removably connected to said flotation device, said waterproof speaker including:

a first housing, a second housing including a recess, and a speaker positioned between said first housing and said second housing, and a back portion of said speaker being sealed in said recess by a waterproof seal, wherein said first housing is removably connected to said second housing;

a wire electrically connected to said waterproof speaker; and a waterproof pocket on said flotation device, said wire extending from said waterproof speaker to said waterproof pocket internally through said flotation device, said wire configured to electrically connect to an electronic device.

2. The flotation device of claim 1, further comprising said electronic device, said electronic device being an amplifier, a media player, or a communication device.

3. The flotation device of claim 1, further comprising a waterproof enclosure housed in said waterproof pocket.

4. The flotation device of claim 3, further comprising a grommet in said waterproof enclosure extending from an exterior to an interior of said waterproof enclosure.

5. The flotation device of claim 4, wherein said wire further extends through said grommet to said interior of said waterproof enclosure.

6. A flotation device including an outer material layer and an inner material layer, said flotation device comprising:

a first housing positioned on an exterior surface of said outer material layer of said flotation device;

a second housing having an inner recess and positioned on an interior surface of said outer material layer of said flotation device and connected to said first housing;

a speaker having a back portion and a front portion, said speaker positioned between said first housing and said second housing with said front portion proximal to said first housing and said back portion sealed in said inner recess of said second housing.

7. The flotation device of claim 6, further comprising a waterproof pocket on a front portion of said flotation device.

8. The flotation device of claim 7, further comprising a wire electrically connected to said back portion of said speaker and extending through said second housing.

9. The flotation device of claim 8, further comprising a waterproof seal on said second housing where said wire extends out of said second housing.

10. The flotation device of claim 9, wherein said wire extends from said speaker to said waterproof pocket, said wire being located between said outer material layer and said inner material layer of said flotation device.

11. The flotation device of claim 10, further comprising an amplifier positioned within said waterproof pocket and electrically connected to said wire, said amplifier configured to electrically connect to a media player or a communication device.

12. A flotation device comprising:

a vest having a front portion, a back portion, and a top opening;

a front flotation pad positioned internally within said front portion of said vest;

a back flotation pad positioned internally within said back portion of said vest;

a waterproof pocket on said front portion of said vest;

a waterproof speaker assembly removably connected to said vest in proximity to said top opening of said vest, said waterproof speaker assembly including:

a first housing, a second housing including a recess, and a speaker positioned between said first housing and said second housing, and a back portion of said speaker being sealed in said recess by a waterproof seal, wherein said first housing is removably connected to said second housing; and a wire electrically connected to said waterproof speaker assembly, said wire running internal to said vest from said waterproof speaker assembly to said waterproof pocket.

13. The flotation device of claim 12, wherein said second housing is positioned on an internal side of an outer material layer of said vest, and said first housing is positioned on an external side of said outer material layer of said vest, said first housing being removably connected to said second housing through said outer material layer of said vest.

14. The flotation device of claim 12, further comprising a waterproof enclosure housed in said waterproof pocket.

15. The flotation device of claim 14, wherein said waterproof enclosure includes a grommet receiving said wire and carrying said wire through said waterproof enclosure to an interior of said waterproof enclosure.

* * * * *